United States Patent [19]

McKay et al.

[11] Patent Number: 4,772,242

[45] Date of Patent: Sep. 20, 1988

[54] WHEELED TOY VEHICLE HAVING POUNDING FISTS

[75] Inventors: Robert S. McKay, Morton Grove; William D. Nelson, Elgin, both of Ill.

[73] Assignee: Up-Trend Design, Wood Dale, Ill.

[21] Appl. No.: 8,614

[22] Filed: Jan. 29, 1987

[51] Int. Cl.[4] ..... A63H 17/26

[52] U.S. Cl. ..... 446/448; 446/292; 446/336

[58] Field of Search ..... 446/448, 449, 451, 465, 446/431, 272, 274, 280, 289, 290, 291–294, 336, 413, 418

[56] References Cited

U.S. PATENT DOCUMENTS

| | | | |
|---|---|---|---|
| 2,167,246 | 7/1939 | Lohr | 446/451 |
| 2,512,533 | 6/1950 | Savage | 446/272 X |
| 3,088,243 | 5/1963 | Giardina | 446/290 |
| 4,568,307 | 2/1986 | Gabler et al. | 446/448 |
| 4,573,944 | 3/1986 | Crow et al. | 446/336 X |

*Primary Examiner*—Mickey Yu

*Attorney, Agent, or Firm*—Kinzer, Plyer, Dorn, McEachran & Jambor

[57] ABSTRACT

A wheeled toy vehicle is disclosed having a frame and a drive wheel rotatably mounted on the frame, to roll across a support surface. A pair of forearms are pivoted to the frame, respectively on its opposite sides. Each forearm has a fist at its forward end and an elbow at its rearward end. Each forearm is constrained to pivot between a raised position having its fist well above the elbow and the support surface, and a lowered position having its fist close to the support surface. A drive couples each forearm, at a location between the elbow and fist, to the drive wheel, for repeatedly raising and lowering each forearm, as the drive wheel is rotated. A pair of upper arms respectively are pivoted to the forearms at the elbows. The upper arm is angled relative to its associated forearm, the angle between each upper arm and forearm being its minimum near the raised position and being its maximum near the lowered position. A mouth is defined by relatively movable lower and upper jaw members supported by the frame. A drive moves the upper jaw member relative to the lower jaw member, to open and close the mouth, in a predetermined timed relationship as said drive wheel is rotated.

10 Claims, 6 Drawing Sheets

102
108
105
106
110
103
113
111
100
34
33
40
37
36
19
14
99
14
15
12
77
82
76
87
79
46
50
31
45
52
44
78
76
85
22
75
66
64
16
53
29
65
62
43
69
63
72
90
96
68
24
73
92
95
93
20
79

WHEELED TOY VEHICLE HAVING POUNDING FISTS

BACKGROUND OF THE INVENTION

Wheeled toy vehicles that can be rolled across a floor or other smooth support surface are of course well known. Frequently, the toy vehicles may be patterned after real-life vehicles, such as scaled-down automobiles, trucks, earth moving or military equipment, or the like. Also, such toy vehicles may be fanciful, such as might be dreamed up for use in science fiction movies or the like. Many toy vehicles may also carry movable characters and/or components, where the movement of such characters or components may be independent of vehicle movement, or may be tied to and/or be powered by such vehicle movement.

SUMMARY OF THE INVENTION

The present invention provides a wheeled toy vehicle having a unique appearance and mode of operation.

The wheeled toy vehicle has a pair of forearms disposed on its sides, each forearm having a fist at the forward end and an articulated elbow joint at the rearward end. Means pivot each forearm about its elbow, as the vehicle is rolled along on a support surface and the vehicle wheels are rotated. This action simulates repeated pounding of the fists against the support surface.

Means also move the elbow joint relative to the vehicle, to move the point about which each forearm is pivoted. The means for pivoting each forearm, and the means for moving each elbow are related, to provide that the fist is raised and lowered, or pounded in a realistic cyclic pattern.

Upper arms respectively may be associated with the forearms, and means provide for raising, lowering and pivoting each upper arm relative to the vehicle and its associated forearm, as the associated forearm is raised, lowered and pivoted.

A mouth may also be provided on the vehicle, between the pounding fists, to be repeatedly opened and closed as the vehicle is moved across the support surface. A lower jaw member may be fixed to the vehicle, an upper jaw member may be movable relative to the lower jaw member, and means may be provided for moving the upper jaw member in a predetermined timed relationship as the vehicle wheels are rotated.

BRIEF DISCRIPTION OF THE DRAWINGS

FIG. 7 illustrates the arm and fist component as the fist is "pounding" the support surface, the arm then being approximately parallel to the support surface;

FIG. 8 illustrates the arm and fist component raised off of the support surface, while the arm is yet approximately parallel thereto;

FIG. 9 illustrates the arm and fist component, after the forearm has initially been rotated, raising the fist higher than the elbow; and FIG. 10 illustrates the arm and fist components, where the fist has been raised approximately to its highest elevation above the support surface, and is now about ready to be moved downwardly as a "pounding" stroke, ending in the position of FIG. 7.

DETAILED DESCRIPTION OF AN ILLUSTRATED EMBODIMENT

Figure 1:
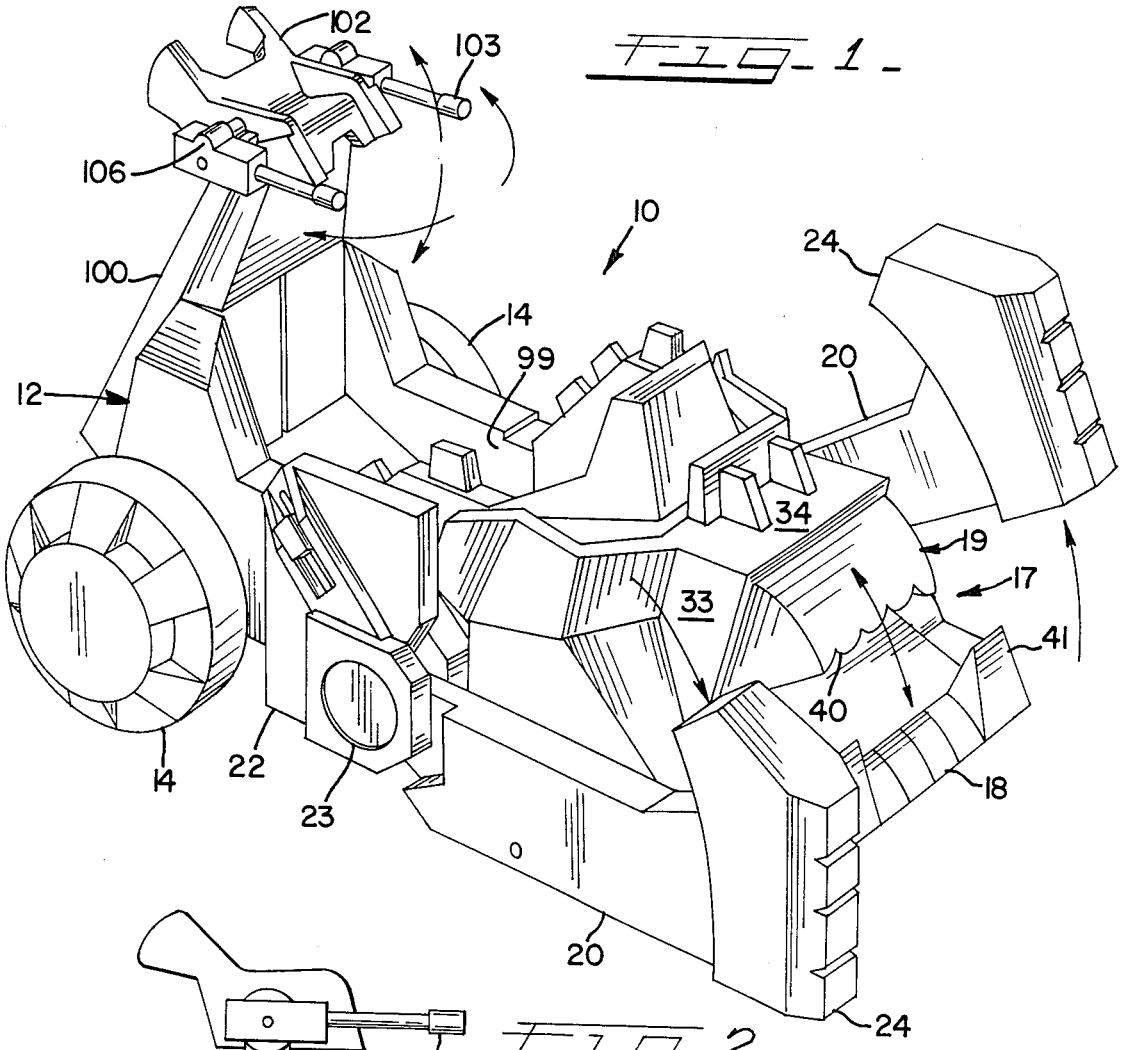
FIG. 1 is a perspective view of the toy vehicle of the present invention.
Figure 2:
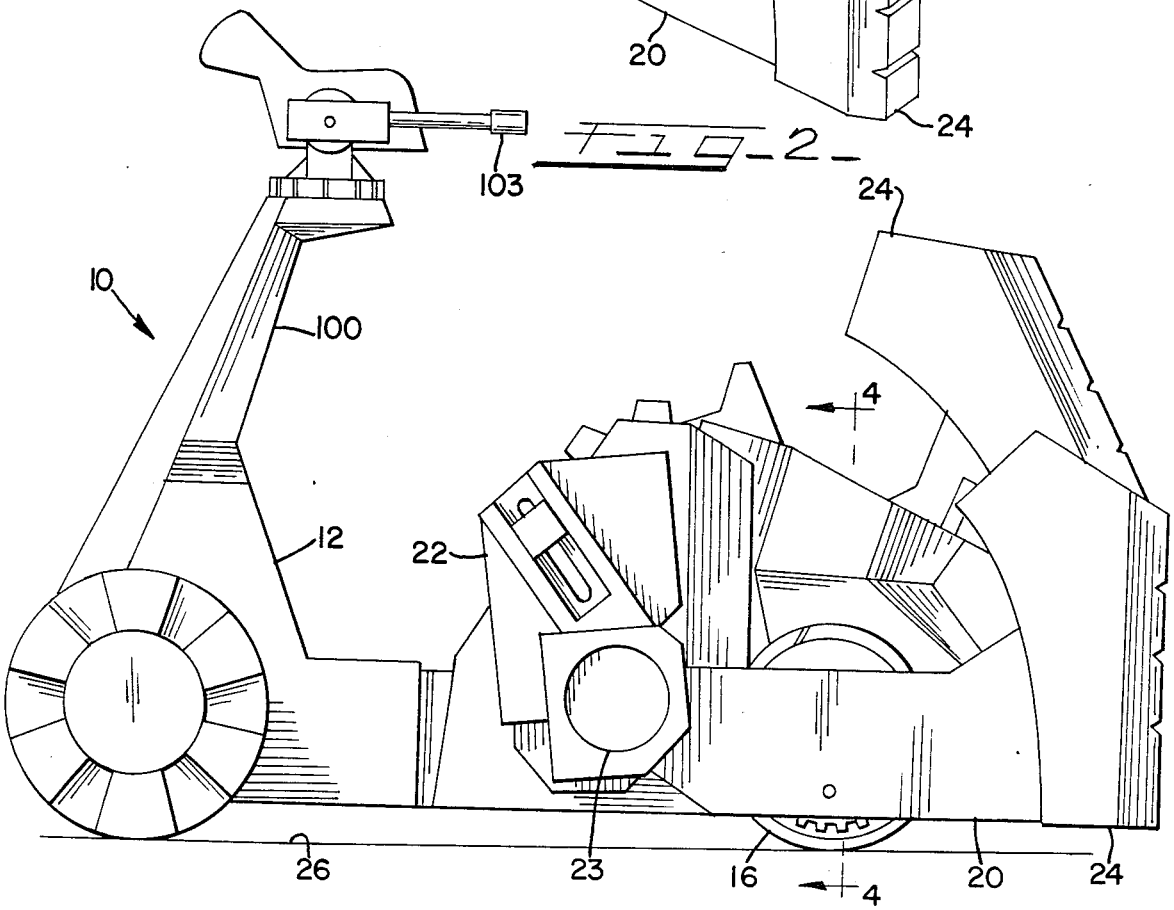
FIG. 2 is a side elevational view of the vehicle of FIG. 1.
Figure 3:
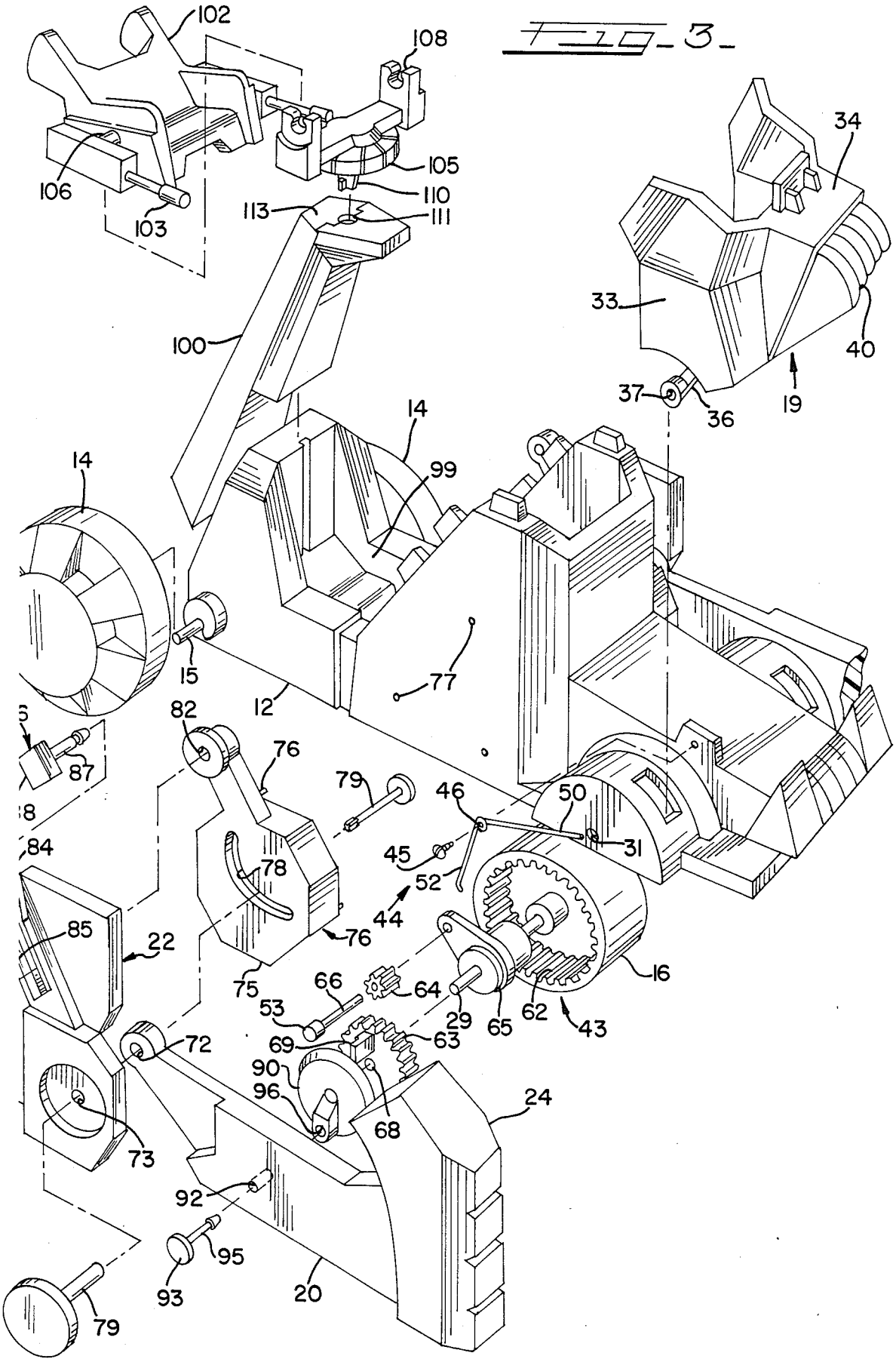
FIG. 3 is an exploded perspective view of the toy vehicle of FIGS. 1 and 2.

The toy vehicle 10 illustrated in FIGS. 1–3 has a shell or frame 12, a pair of rear side wheels 14 mounted to rotate on spindles 15 fixed to the frame, and a single centered front drive wheel 16. A mouth 17, consisting of a stationary lower jaw 18 and a movable upper jaw 19, is defined at the front of the toy vehicle 10. Forearm 20 and upper arm 22, pivoted together at elbow joint 23, are mounted on each side of the vehicle. The forearms 20 have enlarged forward regions, simulating fists 24, that project slightly beyond the front of the mouth 17.

The toy vehicle 10 may be considered to have a fictional appearance, although somewhat related to an animal-like character, having the centered front mouth 17 and the pair of arms 20 and 22 disposed on opposite sides of the mouth.

The toy vehicle 10 is adapted to be rolled along on a smooth floor or other support surface 26. When so moved, the upper jaw 19 of the mouth 17 is repeatedly opened and closed relative to the lower jaw 18; and the arms 20 and 22 are moved relative to the vehicle frame 12, in an up and down, and rotated manner about elbow joints 23, to raise the fists 24 well above the support surface 26 and then lower them rapidly to be close to the support surface, to simulate "pounding" the fists against the surface.

As illustrated if FIGS. 1 and 2, the right and left arms, and fists thereon, are out of phase, where only one fist is in the "pounding" stroke at one time; although the separate fists alternately "pound" the surface upon continuing forward movement of the vehicle 10.

Figure 4:
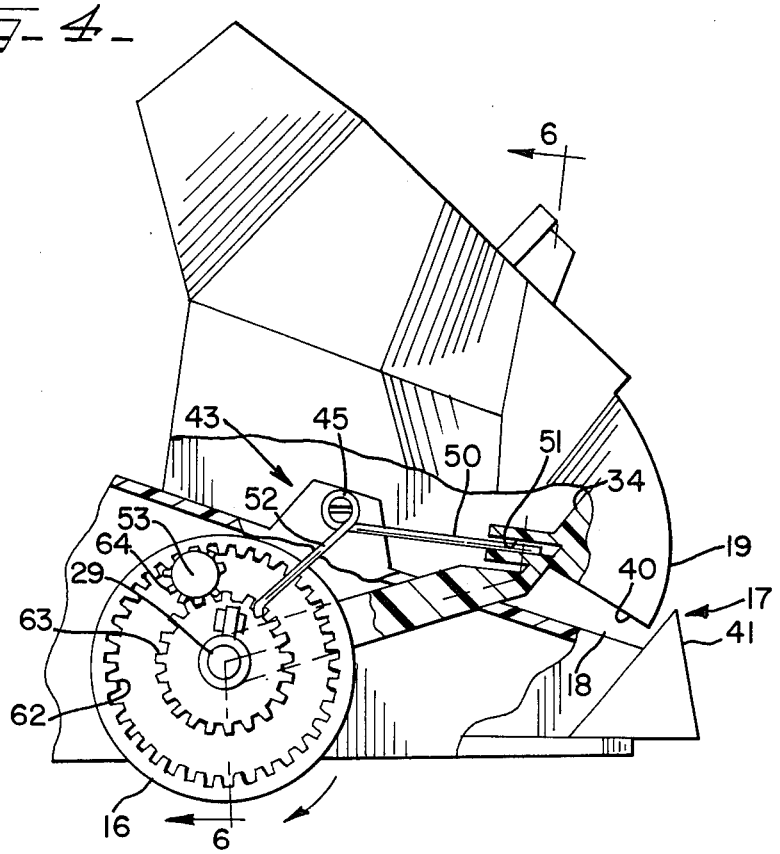
FIG. 4 is a fragmentary elevational sectional view, taken along line 4—4 in FIG. 6, being similar also to FIG. 2, except to a slightly larger scale and specifically illustrating the mechanism for opening and closing the mouth of the toy vehicle.

The front drive wheel 16 is keyed at hub 27 (see FIG. 6) to axle 29, to rotate the axle; and the axle extends through and is rotatably journaled in openings 31 in opposite side walls 32 of frame 12. The lower jaw wall 18 overlies the drive wheel 16 (see FIGS. 4 and 5), being angled downwardly and forwardly somewhat. The upper jaw 19 is of a hollowed three-dimensional configuration, having opposed sides 33 and a connecting intermediate portion 34. Arms 36 are formed off of the sides 33, and each has an open bore 37 at its free end. The arms 36 fit through slots 38 in frame wall 39, and extend to the axle 29; and the axle 29 fits rotatably through the open bores 37, to rotate the upper jaw 19 concentrically of the axle 29.

The intermediate portion 34 of upper jaw 19 may extend forwardly and downwardly to teeth 40 formed thereon, to cooperate with teeth 41 formed on the forward end of lower jaw 18, as the mouth 17 is closed. Much of the upper jaw 19 is located forwardly of its pivot connection about the axle 29, to provide that its weight center is normally offset forwardly of such pivot connection, tending to have the mouth fall by gravity to the closed position.

Mechanism 43, driven by the drive wheel 16, is used to open the mouth 17. The mechanism 43 includes a wire actuator 44 pivoted to the frame 12, by screw 45 extended through an intermediate eyelet 46 in the actuator and threaded into a tap 47 in tab 48 upstanding from the frame 12. Actuator end 50 is fitted into pocket 51 in the upper jaw wall structure 34, to couple the actuator and upper jaw 19 together. Actuator end 52 is adjacent one side of the wheel 16, to line up with and project slightly beyond or radially inwardly of drive pinion 53. The drive pinion 53 projects from the side of the wheel 16 at a fixed radius from the axle 29, and is adapted to rotate around the axle as the wheel rotates.

The actuator end 52 is cammed by the moving drive pinion 53 to pivot the actuator about the screw 45 and open the upper jaw 19. The camming end 52 lines up just outside of a straight line between the screw 45 and axle 29, when the jaw 19 in closed (see FIG. 4), and is cammed to the opposite side of such straight line (see FIG. 5), upon rotation of the drive wheel 16 in a clockwise direction relative to FIGS. 4 and 5 (forward movement of the vehicle), to open the upper jaw 19. As continued drive wheel rotation moves the drive pinion 53 past the camming end 52, the jaw is allowed to fall closed.

In the illustrated embodiment, an epicyclic gear train is formed between the wheel 16 and drive pinion 53. The drive wheel 16 has the hub 27, a cylindrical wall 60, and a radial wall 61 extended between the cylindrical wall and hub. Ring gear 62 is formed on the inside of the cylindrical wall 60, to rotate with the wheel. Sun gear 63 is concentrically disposed on axle 29; but is nonrotatably, being keyed relative to the frame 12. Planet gear 64 is engaged between the ring and sun gears. Planet gear carrier 65, rotatably supported on the exterior of the wheel hub 27, supports shaft 66 radially spaced from the axle 29; and the planet gear 64 is rotatably supported on the shaft 66. The drive pinion 53 is formed on the projected end of the shaft 66, in line with the actuator end 52, as noted above.

The sun gear 63 includes central bore 68 through which the axle 29 freely and rotatably extends; and the sun gear also has a tang 69 that is received between and restrained by spaced radial webs 70 in the frame 12, to key the sun gear nonrotatably to the frame 12. The tang 69 should be radially close to the axle 29, when in line with the actuator end 52, to avoid interference with either the actuator end or the rotating drive pinion 53.

As the sun gear 63 is stationary, rotation of the drive wheel 16 and the ring gear 62 thereon, causes the planet gear 64 to roll between the sun and ring gears, and thereby rotate the carrier 65, shaft 66 and drive pinion 53 around the axle 29. Such rotation will be in the same direction as the rotation of the drive wheel 16, but at a reduced ratio. Thus, for one complete revolution of the drive wheel 16, the drive pinion 53 may be rotated only a partial revolution; or considering it the other way, the wheel 16 may have to be rotated several complete revolutions just to have the drive pinion 53 rotated once. The ratio of teeth in the ring gear 62, the sun gear 63, and the planet gear 64 determines the rotational ratio of the drive wheel and pinion components.

In the vehicle 10 illustrated, the drive wheel 16 may be small, to allow for a low silhouette of the vehicle; but the small wheel must rotate often upon even limited forward movement of the vehicle. One advantage of the disclosed epicyclic gear train drive between the wheel 16 and pinion 53 is that the upper jaw 19 of the mouth 17, will be opened only once ever several revolution of the drive wheel 16.

The separate forearms 20 and upper arms 22 are mounted by structure illustrated in FIGS. 3 and 6–10. Each arm 20 is elongated, having the fist 24 formed at the forward end and having a journal bore 72 formed at the rearward end. The upper arm 22 is eccentially rectangular, having a journal bore 73 formed at the lower end. A guide block 75, adapted to be secured to the vehicle frame 12 by locking barbs 76 being inserted in frame openings 77, has a curved slot 78 formed therein. Headed pin components 79 fitted through the arm bores 72 and 73, and the slot 78, and interlocked together, laterally hold the arms 20 and 22 together, to define the elbow joint 23 previously mentioned.

The upper arm 22 has, at its upper end, a guide slot 84 and larger parallel track 85 formed between spaced rails 89. A slide piece 86, having a shank 87 slidably fitted through the upper arm slot 84, is fixed within a bore 82, formed in the guide block 75 spaced from the slot 78. This restricts movement of the upper arm to that defined by the slot 84. The upper arm slot 84 may be straight, and may be angled upwardly and rearwardly of elbow pin 79; but is not radially extended for the elbow pin 79 but is slightly offset forwardly from the elbow pin, as illustrated in FIGS. 7–10. A head 88 on the outside of the shank 87 is guided slidably between the rails 89 in track 85.

A drive disc 90 is keyed at hub 91 to each end of the axle 29, outwardly of the frame walls 32, to rotate with the axle. A bore 92 is formed in each arm 20, between the rear bore 72 (elbow joint 23) and the fist 24; and a headed pin 93 is adapted to fit through the arm bore 92 and be fixed to each disc 90, offset from the axis of rotation of the axle 29. This rotatably couples the arm 20, via the disc 90 and axle 29, to the drive wheel 16. The pin 93 may have a barbed shank 95 adapted to be interlocked in a socket 96 formed in the disc 90.

In the illustrated embodiment, the slot 78 at 80 is quite sharply curved, for about one-fourth of a circle; and is curved between approximately the 180° and 270° locations, to extend approximately horizontally at one end to extend approximatly vertically at the other end. The slot curvature at 80 may be circular, at least over its lower portion, and may have a radius close to the offset of drive pin 93 from the axle 29. The less curved curvature at 81 of the slot 78 continues from approximately the 180° position of the slot 80, and extends forwardly at least a distance greater than the offset of drive pin 93 from the axle 29. The slot at 81 may have only a slight curvature, about a much greater radius, or may even be along a substantially straight path.

The components are sized to have the elbow pin 79 and drive pin 93 each simultaneously in the respective lowest positions, at approximate 180°, (see FIG. 7); and the forearm 20 then may be substantially parallel to the supporting surface 26. The lowest part of the slot 78 will be near where the portions 80 and 81 meet; and the slot portion 81 may be angled very slightly upwardly and forwardly therefrom. The elbow joint is constrained to follow the curvature of the slot 78.

Figure 6:
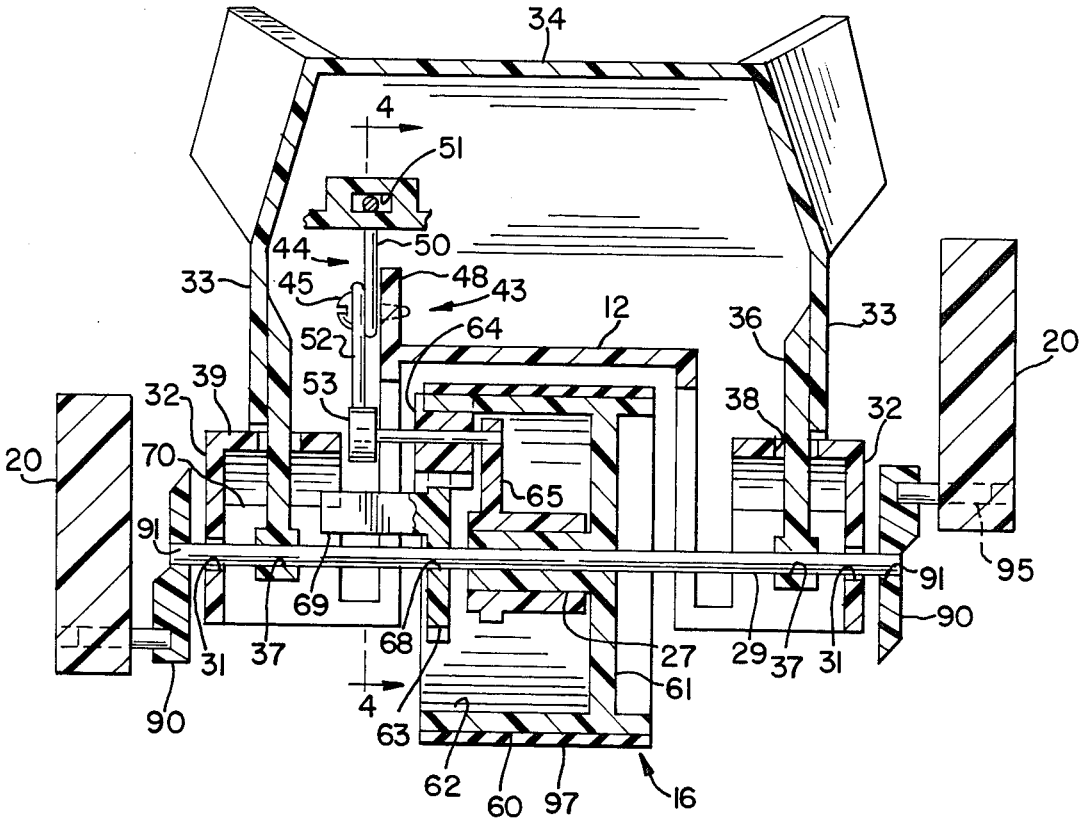
FIG. 6 is a sectional view, taken along line 6—6 in FIG. 4, illustrating the front drive wheel and the mechanism for raising and lowering the arms and fists, and for opening and closing the mouth.

The mechanisms for actuating the right and left forearms 20 and upper arms 22 are similar; except for right and left hand differences, and except for the location of the eccentrically mounted disc pins 93, which as illustrated, are out of phase by 180 degrees from one another (see FIG. 6). This will provide that the separate arms 20 and 22 are moved together, but out of phase. Other phase relations of the arms are possible; and different relative rotational positions of the eccentric drive pins 93 will control such.

It will be appreciated that sufficient clearance, and antifriction bearings or coatings may be provided at the moving bearing contacts between the adjacent components, to ensure reliable, smooth and easy moving action. The components might typically be formed of a durable plastic. Also, a rubber tire 97 (FIG. 6) may be secured on the cylindrical wall 60 of the drive wheel 16, to provide for good traction, so that the drive wheel will rotate rather than slide, as the vehicle 10 is moved along the support surface 26.

In a more simplified embodiment (not shown), the epicyclic gear train drive between the drive wheel 16 and pinion 53 may be eliminated, and replaced by a drive pinion supported directly from one side of a conventional solid drive wheel, to cam the upper jaw actuator 44. This construction might be similar to pin 93 projecting from the side of drive disc 90, and would provide that the upper jaw 19 would be opened and closed every revolution of the drive wheel 16.

Another aspect of the vehicle 10 is that means are provided to carry about selected items, including toy figures (not shown). Thus, the frame walls 12 are dished near the mid-section of the vehicle, to define a top-open hopper 99 on the vehicle 10. Also, a post 100 at the rear of the frame 12 projects higher than all adjacent components, and crow's nest seat 102 and side guns 103 may be secured thereto at the upper end. The seat 102 and guns 103 may be secured to platform 105, by seat pins 106 being snapped into open grooves 108 in the platform, to allow rocking of the seat and guns about the pins. The platform 105 may be swiveled to the post 100, by pin 110 being rotatably snapped in post bore 111, located centrally of swivel face 113. This allow rotational, horizontal, and vertical adjustment of the seat 102 and guns 103.

SUMMARY OF THE OPERATION

The disclosed toy vehicle 10 has a fictional appearance and mode of operation as it is rolled on support surface 26. Forearms 20 and upper arms 22, pivoted together at elbows 23, are mounted on each side of the vehicle; and a fist 24 is formed at the front of each forearm 20, at the front of the vehicle.

The upper arm 22 is constrained at its upper end to follow the upper arm slot 84 and/or track 85, guided by pin shank 87 supported in frame bore 82. The lower end of upper arm 22 and the rearward end of the forearm 20, are pivoted together defining the elbow joint 23; and are constrained to follow the frame slot 78. The intermediate part of the forearm 20, at bore 92, is constrained to follow the eccentrically rotated drive pin 93 on the disc 90. The drive pins 93 are rotated by drive wheel 16.

As the drive wheel 16 is rotated, the constrained arms 20 and 22 move realistically, much like human arms, according to the action of repeatedly raising each fist 24 above the support surface 26 and then rapidly lowering such fist, simulating pounding such fist against the support surface. The right and left arms are alternately operated in a pounding stroke, perhaps 180 degrees of phase from one another.

Figure 7:
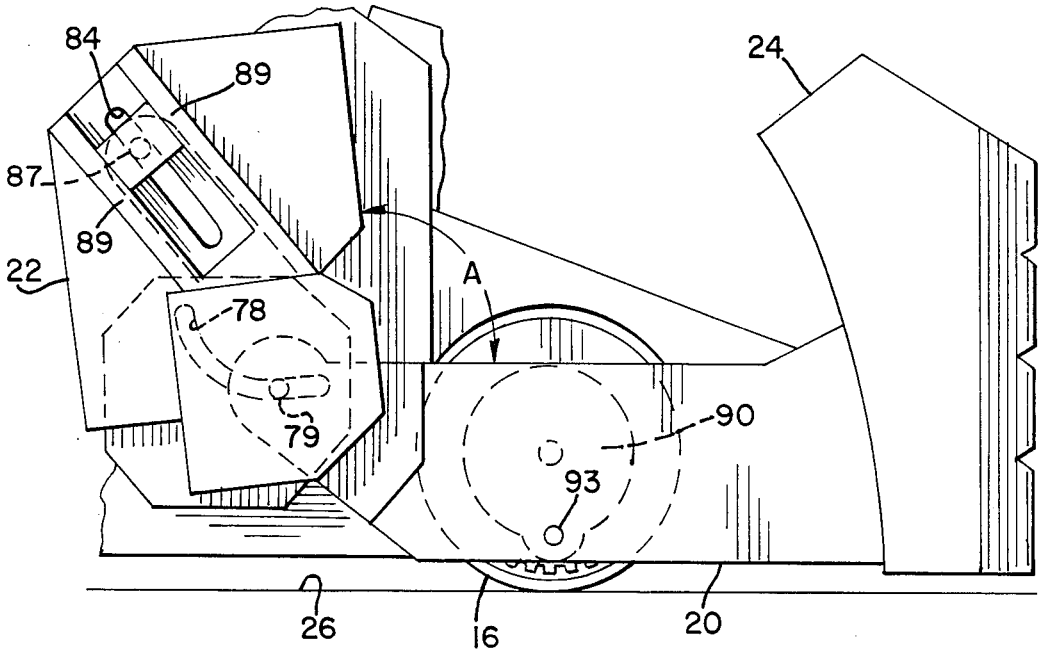
FIGS. 7, 8, 9 and 10 are fragmentary, side elevational views of the vehicle, similar to FIG. 2, except being to a slightly larger scale and illustrating the near-side arm and fist components in progressive operative positions, during continued forward movement of the vehicle (to the right in FIGS. 2 and 7–10); and specifically where.

In FIGS. 2 and 7, the arms 20 and 22 on the right side of the vehicle 10 are illustrated in the down position; and the left side arms are raised above the support surface 26. In the down position, the forearm 20 may be substantially parallel to the support surface 26, and the upper arm 22 is angled up from elbow 23 at slightly more than a 90 degree included angle. Eccentric drive pin 93 in the forearm 20 is approximately at the 180° position, vertically aligned below the drive wheel axle 29; and elbow pin 79 is also approximately at the lowermost position of the slot 78.

Figure 8:
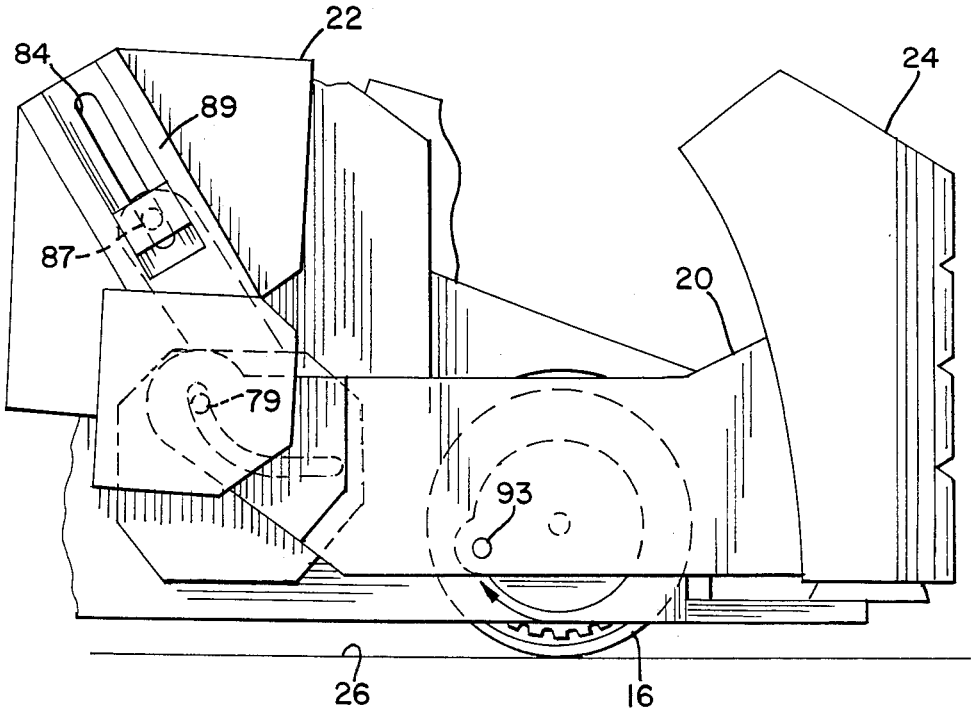

Upon clockwise rotation of drive wheel 16 to perhaps the position of FIG. 8, the drive pin 93 moves to approximately the 260° position, and the right forearm 20 is moved rearwardly relative to the frame 12 and is moved upwardly away from the support surface 26. However, the forearm 20 does not appreciably rotate, but may remain substantially parallel to surface 26. The pin 79 moves rearwardly and upwardly within the more curved portion 80 of slot 78, to approach its highest position in the slot. The right upper arm 22 is raised approximately the same distance as the right forearm 20; placing the block 87 near the bottom if its slot 84, but it is angled somewhat to close the included angle A between the arms 20 and 22 to just less than 90 degrees.

Figure 9:
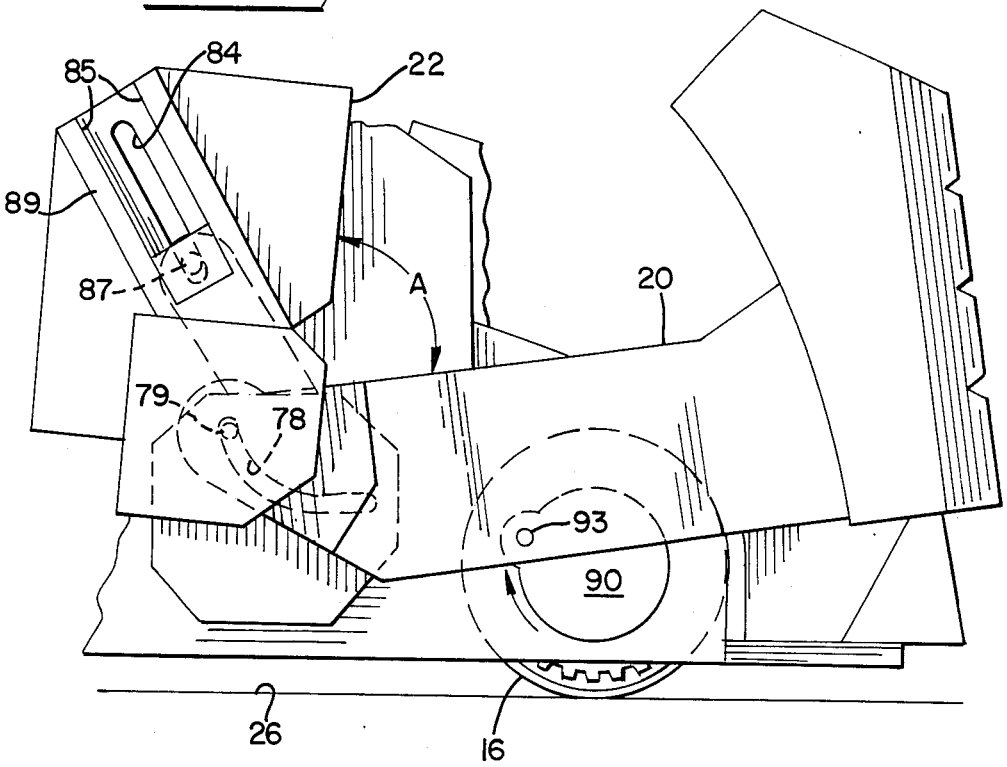

Upon continued clockwise rotation of drive wheel 16 from FIG. 8 to FIG. 9, the drive pin 93 continues to move away from the support surface, but is now to about the 280° position; and such pin also begins to move forwardly of the frame. The elbow pin 79 now follows the curved part 80 of the slot 78 downwardly to drop slightly and also to move forwardly relative to the frame. This rotates the forearm 20 in a counter-clockwise direction which raises the fist 24 rapidly above the elbow 23. The upper arm 22 also begins to move slowly toward the support surface, which causes it to rotate somewhat in a counter-clockwise direction, but at a much slower rate than the rotation of the forearm. The included angle A between the arms 20 and 22 thus continues to close.

Figure 10:
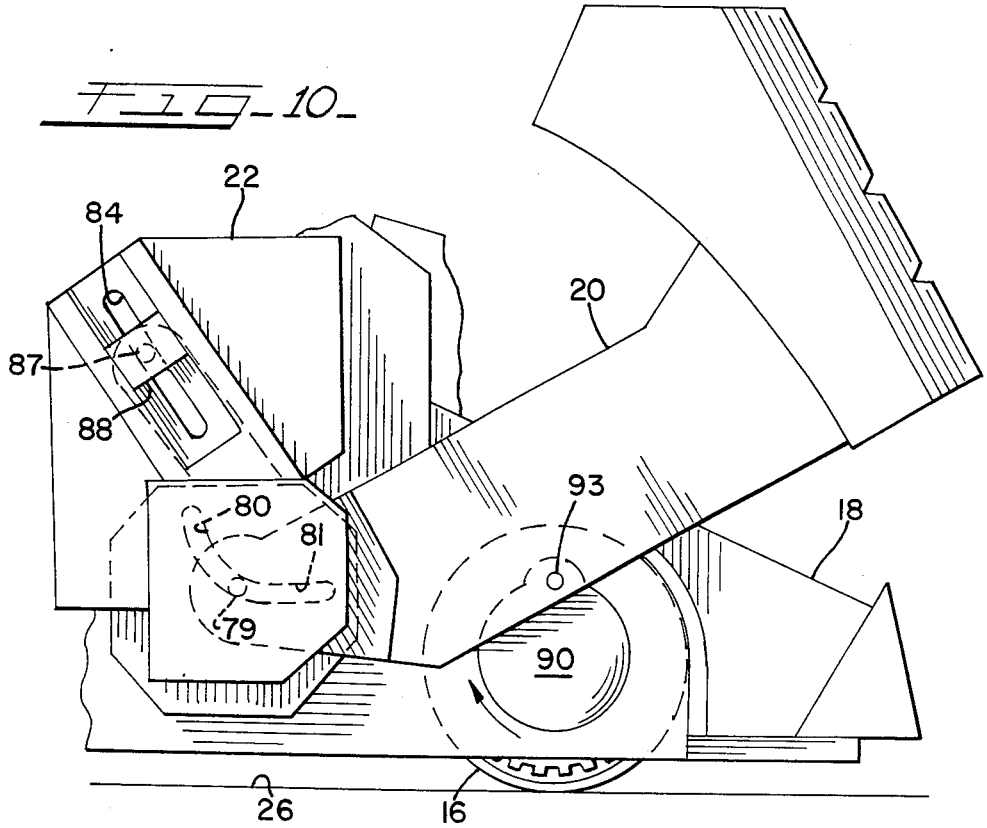

Upon continued clockwise rotation of drive wheel 16 from FIG. 9 to FIG. 10, the drive pin 93 continues to move upwardly away from the support surface 26 and forwardly of the frame, toward the 0° or 360° position; while the elbow pin 79 continues to move in the more curved part 80 of the slot 78 toward the support surface 26 and also forwardly relatiive to the frame. This continues to rotate the forearm 20 in a counter-clockwise direction, to raise the fist 24 to approximately its highest postion, as illustrated in FIG. 10. The included angle A between the arms 20 and 22 closes to its minimum approximately with the fist at its maximum height.

The pounding stroke occurs between FIGS. 9 and 10, upon continued clockwise rotation of drive wheel 16, where drive pin 93 moves downwardly toward the support surface 26, and forwardly initially, relative to the frame, to the 90° position and then rearwardly; while the elbow pin 79 follows in the less curved part 81 of the slot 78, yielding a forward and rearward movement relative to the frame, that may be only slightly inclined relative to the support surface 26. This rotates the forearm 20 in a clockwise direction to move the fist 22 rapidly to the position of FIG. 7. The upper arm 22 also continues to rotate in a counter-clockwise direction, to open the included angle A between the arms 20 and 22 to its maximum sometime during the pounding stroke.

This arm movement simulates a real human-like effort, with the upper arm 22 leaning into the forearm 20 as the fist 24 is being raised to its highest cocked position, and then falling away from the forearm as the fist is being moved down in the pounding action. In reality, the fists 24 may not actually contact the support surface 26, but only come close to it.

The mouth 17 on the front of the vehicle 10, between the pounding fists 24, is repeatedly opened and closed as the vehicle is moved on the support surface 26. Upon the drive wheel 16 rotating in a clockwise direction relative to FIGS. 4 and 5 (forward movement of the vehicle), the rotating drive pinion 53 hits the camming end 52 of actuator 44 to rotate the actuator in a counterclockwise direction around the screw 45 and open the upper jaw 19 in a counterclockwise direction.

Figure 5:
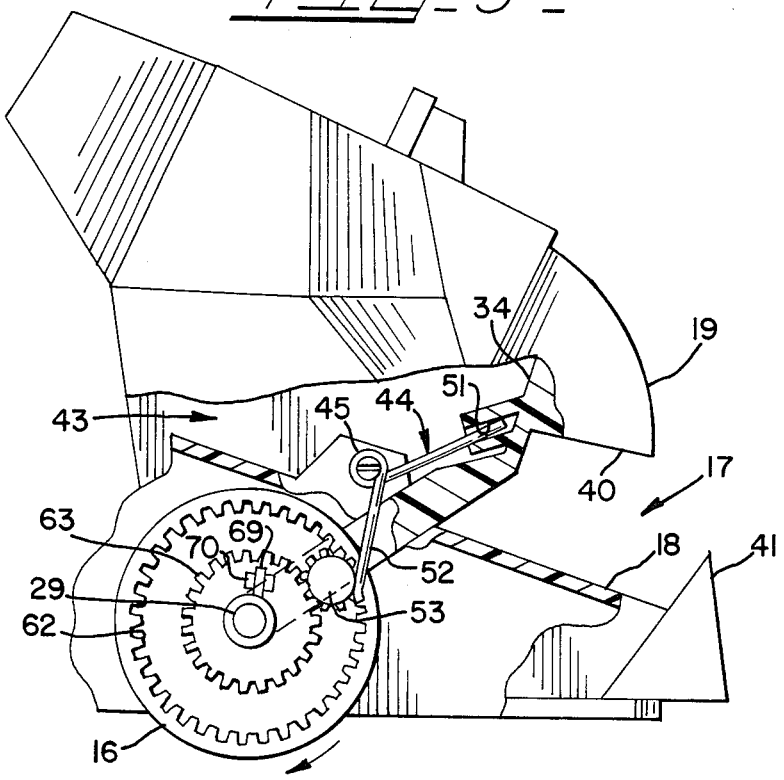
FIG. 5 is a fragmentary elevational sectional view similar to FIG. 4, except illustrating the mechanism in a position where the mouth is open.

In the position of FIG. 5, the mouth is about fully opened, and continued clockwise rotation of the wheel will cause the drive pinion 53 to pass camming end 52 of the actuator 44, to allow the jaw to fall closed.

While only a single embodiment of the invenion has been illustrated, it is apparent that variations may be made therefrom without departing from the inventive concept. Accordingly, the invention is to be limited only by the scope of the following claims.

What is claimed is:

1. A wheeled toy vehicle comprising a frame and a drive wheel rotatably mounted on the frame;

a forearm having a fist at one end;

means defining a pivot point and mounting said forearm relative to the frame to allow the first to be moved between raised and lowered positions;

means coupled between the drive wheel and forearm, to move the fist between the raised and lowered positions as the vehicle is rolled across a support surface and said drive wheel is rotated; and slot means in the frame allowing said forearm mounting means to move relative to the frame responsive to rotation of the drive wheel, the pivot point about which the forearm is moved being constrained to move in said slot means.

2. A wheeled toy vehicle as claimed in claim 1, further wherein said means coupled between the drive wheel and forearm, to move the fist between the raised and lowered positions, includes means eccentrically rotated relative to the drive wheel and adapted to engage the forearm intermediate its ends.

3. A wheeled toy vehicle as claimed in claim 1, further including an upper arm; means for pivoting said upper arm to the forearm at said pivot point.

4. A wheeled toy vehicle as claimed in claim 1, wherein said forearm is disposed approximately parallel to the support surface when the fist is in the lowered position and in close proximity to the support surface; and said forearms being angled relative to the support surface when the fist is in the raised position, with the fist substantially raised above the forearm mounting means and the support surface, compared to the lowered position.

5. A wheeled toy vehicle as claimed in claim 4, further including an upper arm associated with said forearm, and means for pivoting said upper arm relative to its associated forearm at said forearm mounting means; and means for moving said forearm mounting means relative to the frame, as said drive wheel is rotated, to thereby move the pivot point about which the forearm and upper arm are pivoted.

6. A wheeled toy vehicle as claimed in claim 1, further including a mouth on the vehicle;

said mouth having a lower jaw member and an upper jaw member movable relative to the lower jaw member; and means for moving said upper jaw member in a predetermined timed relationship relative to the rotation of said drive wheel.

7. A wheeled toy vehicle as claimed in claim 6, further including an axle supported relative to the frame, said drive wheel being keyed to said axle, and means mounting said upper jaw member to pivot about an axis parallel to the axle, for such movement relative to the lower jaw member.

8. A wheeled toy vehicle comprising a frame and wheels including a drive wheel rotatably mounted on the frame for supporting the same;

a pair of forearms, each having a first at one end and an elbow at the opposite end;

a pair of upper arms respectively associated with said forearms, each upper arm having an elbow at the lower end, and pivot means pivoting the associated forearms and upper arms together at the elbows;

slot means guiding each forearm pivot means to move relative to the frame, such that the forearm moves between raised and lowered positions respectively having each fist raised above the elbow and having each fist substantially the same height as the elbow;

track means guiding each upper arm to move relative to the frame, between positions corresponding to said raised and lowered positions of the forearms, respectively angles relative to the associated forearm;

said slot and track means for the forearms and for the upper arms being related to one another, to provide that the angle between each upper arm and its associated forearm changes as said forearm is moved between the raised and lowered positions, being at its minimum near the raised position and being at its maximum near the lowered position; and means coupling forearm, between the elbow and fist, to the drive wheel, for raising and lowering each forarm relative to the frame as the drive wheel is rotated.

9. A wheeled toy vehicle as claimed in claim 8, further including lower and upper jaw members supported by said frame and defining a mouth, said upper jaw member being movable relative to the lower jaw member, and means for moving said upper jaw member relative to the lower jaw member in a predetermined timed relationship as said drive wheel is rotated.

10. A wheeled toy vehicle, comprising:

a frame having a slot formed therein;

a drive wheel rotatably mounted on the frame;

a forearm having a fist at one end and having a pivot pin at the other slidably disposed in the slot;

an upper arm pivotally mounted on said pivot pin and having a track formed therein;

a slide piece attached to the frame and disposed in the track of the upper arm such that sliding motion of the upper arm is along the slide piece;

means coupled between the drive wheel and forearm, to move the fist between raised and lowered positions as the vehicle is rolled across a support surface and said drive wheel is rotated.

* * * * *